US009061187B2

(12) United States Patent
Yount

(10) Patent No.: US 9,061,187 B2
(45) Date of Patent: Jun. 23, 2015

(54) GOLF PUTTER WITH REPOSITIONABLE SHAFT

(71) Applicant: Jack Yount, Fayetteville, NC (US)

(72) Inventor: Jack Yount, Fayetteville, NC (US)

( * ) Notice: Subject to any disclaimer, the term of this patent is extended or adjusted under 35 U.S.C. 154(b) by 11 days.

(21) Appl. No.: 13/735,012

(22) Filed: Jan. 6, 2013

(65) Prior Publication Data

US 2014/0194218 A1 Jul. 10, 2014

(51) Int. Cl.

| | |
|---|---|
| ***A63B 53/02*** | (2006.01) |
| ***A63B 53/16*** | (2006.01) |
| ***A63B 53/06*** | (2015.01) |

(52) U.S. Cl.

CPC ..... *A63B 53/065* (2013.01); *A63B 53/02* (2013.01); *A63B 2053/028* (2013.01)

(58) Field of Classification Search

CPC ..... A63B 53/02; A63B 53/16; A63B 53/065; A63B 2053/022; A63B 2053/028

USPC ..... 473/340–341, 306–307, 313, 315, 244, 473/288, 298–299

See application file for complete search history.

(56) References Cited

U.S. PATENT DOCUMENTS

| | | | | |
|---|---|---|---|---|
| 3,392,977 | A * | 7/1968 | De Lacey | 473/306 |
| 3,397,888 | A * | 8/1968 | Springer et al. | 473/248 |
| 4,943,059 | A * | 7/1990 | Morell | 473/306 |
| 5,924,938 | A * | 7/1999 | Hines | 473/307 |
| 6,386,991 | B1 * | 5/2002 | Reyes et al. | 473/346 |
| 7,326,121 | B2 * | 2/2008 | Roake | 473/251 |
| 7,736,243 | B2 * | 6/2010 | Sanchez et al. | 473/288 |
| 8,142,307 | B2 * | 3/2012 | Sanchez et al. | 473/288 |

* cited by examiner

*Primary Examiner* — Stephen Blau
(74) *Attorney, Agent, or Firm* — The Law Office of Jerry D. Haynes

(57) ABSTRACT

A golf putter with repositionable shaft comprising a head, where the head is composed of a top surface, a striking face, a back face, a first end and a second end: three receiving holes along the top surface of the head, where the receiving holes include a threaded inner surface, and a bottom protrusion positioned horizontally within the receiving hole; a pair of plugs threaded into two of the receiving holes; a shaft fitted into one of the receiving holes, where the shaft repositions with the pair of plugs to fill each receiving hole; and a fitting at a bottom end of the shaft, where the fitting includes an insert with a bottom groove, where the bottom groove receives the bottom protrusion to lock the shaft into place within one of the receiving holes.

10 Claims, 2 Drawing Sheets

GOLF PUTTER WITH REPOSITIONABLE SHAFT

BACKGROUND OF THE INVENTION

1. Field of the Invention

The present invention relates to a golf putter that enables a golfer to change the positioning of the shaft against the head, allowing for exchange of preferred putting styles with the same putter.

2. Description of Related Art

Golf is a sport enjoyed by a wide range of individuals the world over. Many people like to golf for the leisurely experience of being outside and socializing with others. Others thrive from the competitive side of the sport constantly trying to improve and even winning money and prizes at tournaments. While the reasons to play may differ, a few pieces of equipment are standard to each golfer. For example, each person needs a set of clubs and a ball. The type of clubs varies for each user depending on the length of the shaft, size and weight of the head etc. Each golfer has their favorite equipment specifically chosen and fitted to them.

Because each golfer has preferred clubs and balls, exchange and sharing of clubs between golfers is often difficult or discouraged. What correctly fits one person may be completely wrong for another. One of the clubs which golfers may become increasingly finicky about is the putter. The putter is typically a heavy head club designed for use at close distances to the cup, typically on the green. The green is considered the most technical part of the game; therefore a golfer's preference of putter is usually very specific. Some individuals may carry more than one putter simply depending on the type of green, where the style of putter shaft varies from a standard length, a bend at the neck, or an elongated shaft like a belly shaft. Some golfers putt ambidextrously which allows them to putt right or left handed, thus requiring the golfer to carry both right and left hand putters to accommodate their style. Often such a luxury is a burden to correctly fit, expensive to purchase and crowded within the golf bag, so most people simply stick to just a single putter.

It would be desirable in the art to provide a golf putter that allows for exchange between right and left hand users. It would also be beneficial in the art to provide a golf putter that allows for use with different styles of shafts in a single putter head.

SUMMARY OF THE INVENTION

In view of the foregoing disadvantages inherent in the prior art, the general purpose of the present invention is to provide a golf putter that allows for exchange between different shafts, configured to include all of the advantages of the prior art, and to overcome the drawbacks inherent therein.

Accordingly, an object of the present invention is to provide a golf putter with a head that is interchangeable between different types of shafts.

To achieve the above objects, in an aspect of the present invention, a golf putter with repositionable shaft is described comprising a head, where the head is composed of a top surface, a striking face, a back face, a first end and a second end: three receiving holes along the top surface of the head, where the receiving holes include a threaded inner surface, and a bottom protrusion positioned horizontally within the receiving hole; a pair of plugs threaded into two of the receiving holes; a shaft fitted into one of the receiving holes, where the shaft repositions with the pair of plugs to fill each receiving hole; and a fitting at a bottom end of the shaft, where the fitting includes an insert with a bottom groove, where the bottom groove receives the bottom protrusion to lock the shaft into place within one of the receiving holes.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to a golf putter that enables a golfer to change the positioning of the shaft against the head, allowing for exchange of preferred putting styles with the same putter. The present invention provides a golf putter with repositionable shaft where a fixed shaft may be repositioned to three different portions of the head. By allowing repositioning the golf putter may be used by either right or left handed golfers. Also, the shaft itself may be exchanged between standard, belly and long shaft lengths.

Figure 1:
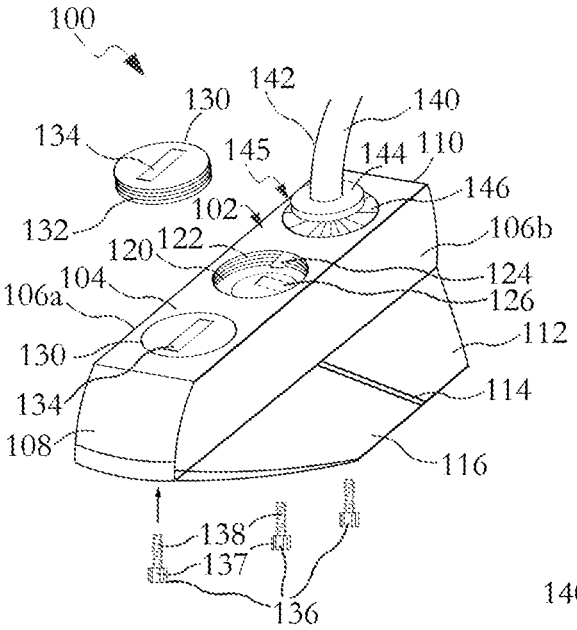
FIG. 1 depicts a perspective view of a golf putter with a repositionable shaft in accordance with an exemplary embodiment of the present invention.

Turning now descriptively to the drawings, referring to FIG. 1, a perspective view of a golf putter with a repositionable shaft 100 is shown in accordance with an exemplary embodiment of the present invention. The golf putter with the repositionable shaft 100 includes a head 102 at the lowermost portion of the putter 100, and a shaft 140 attached to a top surface 104 of the head 102. The head 102 is composed of a top surface 104, a pair of side faces 106*a* 106*b*, a first end 108, a second end 110 and a bottom surface (illustrated in FIG. 4). The pair of side faces 106*a*, 106*b* embody the elongated side portions of the putter, and comprises a striking face 106*a* and a back face 106*b*. The striking face 106*a* is the portion of the head 102 that comes into contact with a golf ball. The back face 106*b* is on the opposing side from the striking face 106*a*.

Extending from the back face 106*b* of the head 102 is a platform 112. The platform 112 may be weighted. Atop the platform 112 is a central striking line 114 where the user ideally aligns the golf ball with the central striking line 114 to optimally hit the golf ball. The platform 112 may comprise a semi-circular shape, or alternatively a semi-circular shape with a flat end 116.

Along the top surface 104 are a set of top receiving holes 120. Three top receiving holes 120 are positioned on the top surface 104 of the head 102. The top receiving holes 120 are evenly spaced along the top surface 104 where one hole is towards the first end 108, another hole is towards a second end 110 and a final hole aligned with the central striking line 114. Within each top receiving hole 120 is a threaded inner surface 122 along the upper portion. At the bottom of the top receiving holes 120 are a pair of wall protrusions 124. The wall protrusions 124 extend vertically along the inner wall of the top receiving holes 120 below the threaded surface 122. At the bottom of the top receiving hole 120 is a bottom protrusion 126. The bottom protrusion 126 extends horizontally along the bottommost surface of the top receiving hole 120.

Fitting within the top receiving hole 120 is a plug 130. The plug 130 includes a threaded peripheral surface 132 that threads together with the threaded inner surface 122 of the top receiving hole 120. Atop the plug 130 is a slot 134. During use the plug 130 is threaded into the top receiving hole 120. The plug 130 screws into the top of the top receiving hole 120 along the threaded inner surface 122, and stops above the wall protrusion 124. To further tighten and to loosen the plug 130 a user may use the slot 134 with a screwdriver, a coin or another flat object to provide additional turns to the plug 130. Two plugs 130 are provided with the head 102 so that two of the three top receiving holes 120 are covered at a time.

While the plugs 130 are within two of the receiving holes 130 the final remaining hole receives the shaft 140. The shaft 140 may include a bend 142 for an angled shaft. The bottom end of the shaft 140 includes a fitting 145. The fitting 145 inserts into the third top receiving hole 120 without the plugs 130. Details of the fitting 145 are explained in detail below in reference to FIG. 2. A top portion of the fitting 145 includes a nut 144 and a cap 146. The nut 144 and cap 146 screw the fitting 145 into the threaded inner surface 122 of the top receiving hole 120. With the plugs 130 and the shaft 140 with the fitting 145 the three top receiving holes 120 of the head 102 are filled to create a custom fitted golf putter.

To further secure the shaft 140 to the head 102 are a set of bolts 136. The bolts 136 include a head 137 and a threaded tail 138. The bolts 136 may be hex bolts for tight and secure fastening. The bolts 136 screw into the bottom surface of the head 102 to ensure that the head 102 does not rotate or move during use. Additional explanation of the bolts is explained in reference to FIG. 4 below.

Figure 2:
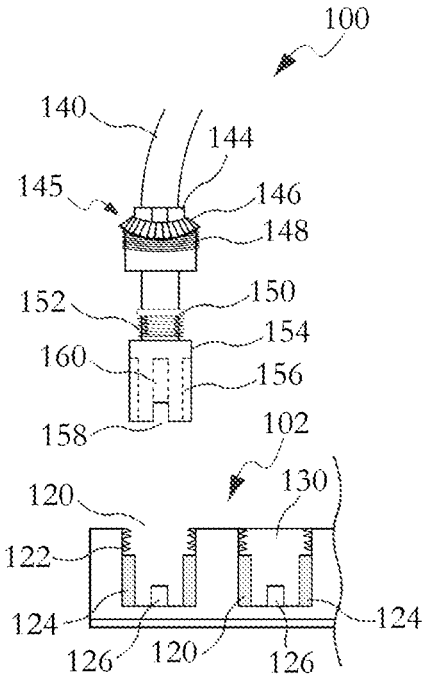
FIG. 2 depicts a side view of a golf putter with the repositionable shaft in accordance with an exemplary embodiment of the present invention.

Referring now to FIG. 2, a side view of the golf putter with the repositionable shaft 100 through a cross-section of the head 102 is shown in accordance with an exemplary embodiment of the present invention. The fitting 145 includes a plurality of components to enable the shaft 140 to fasten to the head 102. Beneath the nut 144 and cap 146 are a plurality of threads 148, creating an essentially threaded cap for the fitting 145. The threads 148 allow the fitting 145 to screw into the threaded inner surface 122 of the top receiving hole 120. The nut 144, cap 146 and threads 148 are fastened together and rotate independently from the shaft 140 to allow the shaft 140 to fasten to the head 102 without rotating with the threaded cap. Further down the fitting 145 is a washer 150 positioned above a spring 152. The washer 150 provides a compression point for the spring 152 as the threads 148 press down into the top receiving hole 120.

Below the spring is an insert 154. The insert 154 fits into the bottom portion of the top receiving hole 120 where the wall protrusion 124 and the bottom protrusion 126 are positioned. Within the insert 154 is a pair wall grooves 156 that receive the pair of wall protrusions 124 from the top receiving hole 120. The insert 154 also includes a bottom groove 158 to receive the bottom protrusion 126. When the grooves 156, 158 of the insert 154 are fitted with the protrusions 124, 126, the fitting 145 is locked into the top receiving hole 120. The insert 154 locks the fitting 145 and thereby the shaft 140 within the head 102. Once the insert 154 is positioned within the top receiving hole 120 and locked in place, the cap 146 presses the threads 148 against the washer 150 and spring 152. The threaded cap screws into the threaded inner surface 122 of the top receiving hole 120 to securely attach the shaft 140 to the head 102. Finally, the insert 154 includes a bolt receiver 160 to receive the threaded tail 138 of the bolt 136.

In the proximal top receiving hole 120 the plug 130 is securely threaded into place. FIG. 2 illustrates how the plug 130 rests above the wall protrusions 124 and the bottom protrusion 126. The fitting 145 of the shaft 140 may be inserted into either of the side receiving holes, as shown, or within the central receiving hole, where the plug 130 is shown. This provides options for the user to position the shaft 140 where they prefer within the head 102.

Figure 3:
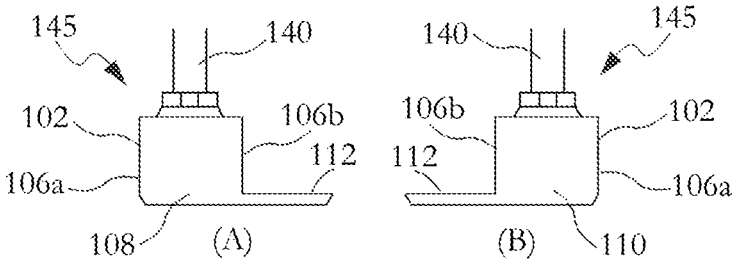
FIG. 3A depicts a rear view of a golf putter with the repositionable shaft in a right hand position in accordance with an exemplary embodiment of the present invention.
FIG. 3B depicts a rear view of a golf putter with the repositionable shaft in a left hand position in accordance with an exemplary embodiment of the present invention.

FIG. 3A illustrates a rear view of the head 102 of the golf putter with repositionable shaft 100 in a right hand position. The fitting 145 and the shaft 140 are positioned within the top receiving hole 120 nearest the first end 108, thus the receiving hole nearest the front of the present view. The first end 108 is positioned in the forefront, with the striking face **106*a* on the left side of the head 102 and the platform 112 on the right side. FIG. 3B illustrates the rear view of the head 102 of the golf putter with repositionable shaft 100 in a left hand position. The fitting 145 and the shaft 140 are positioned within the receiving hole nearest the second end 110. The second end 110 is positioned in the forefront with the platform on the left side and the striking face 106*a*** on the right.

With the golf putter with repositionable shaft 100 the shaft 140 is positionable in a variety of locations along the head 102. This allows for exchange between different shafts 140 within the head 102. The shaft 140 may be a standard sized shaft for a male or female use. Alternatively, the shaft 140 may be a long or belly shaft. By providing exchange between different shafts 140, the same head 102 may be interchanged between multiple users, especially useful for exchange between right handed and left handed use.

Figure 4:
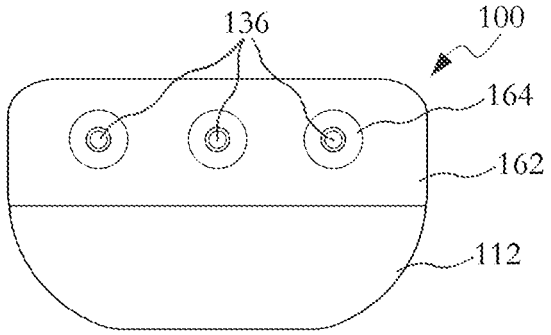
FIG. 4 depicts a bottom view of a golf putter with the repositionable shaft in accordance with an exemplary embodiment of the present invention.

Referring now to FIG. 4, the bottom surface 162 of the head 102 is illustrated. Within the bottom surface 162 are three bottom receiving holes 164, opposite to the receiving holes 120 on the top surface 104. The bottom receiving holes 164 align with the receiving holes 120 to ensure that the bolts 136 insert directly into the bolt receiver 160 of the insert 154. When the threaded end 138 of the bolt 136 is in the bolt receiver, the insert 154 is provided additional strength to prevent rotational movement which can drastically effect how the user strikes the golf ball.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A golf putter with repositionable shaft comprising:

a. a head, where the head is composed of a top surface, a bottom surface, a striking face, a back face, a first end and a second end:

b. three top receiving holes along the top surface of the head, where a first top receiving hole is positioned near the first end, a second top receiving hole is positioned in a center of the head, and a third top receiving hole is positioned near the second end, and where the top receiving holes include:

i. a threaded inner surface; and ii. a bottom protrusion positioned horizontally within the top receiving hole;

c. a pair of plugs threaded into two of the top receiving holes;

d. a shaft fitted into one of the top receiving holes, where the shaft repositions with the pair of plugs to fill each top receiving hole; and e. a fitting at a bottom end of the shaft, where the fitting includes an insert with a bottom groove, where the bottom groove receives the bottom protrusion to lock the shaft into place within one of the top receiving holes, and the fitting further includes a bolt atop a threaded cap positioned above the insert, where the bolt and threaded cap screw into the threaded inner surface of the top receiving hole to further secure the head to the shaft, and where a washer and a spring are positioned between the threaded cap and the insert, where the spring compresses after the insert is locked in place and the threaded cap is screwed into place.

2. The golf putter with repositionable shaft according to claim 1, where each of the pair of plugs includes a threaded peripheral surface to engage the threaded inner surface of the top receiving hole.

3. The golf putter with repositionable shaft according to claim 2, where each of the pair of plugs includes a slot, where the slot enables further tightening and loosening of the plug within the top receiving hole.

4. The golf putter with repositionable shaft according to claim 1, where the head includes a platform extending from the back face, where the platform includes a central striking line.

5. The golf putter with repositionable shaft according to claim 1, where the insert further includes a pair of wall grooves which receive a pair of wall protrusions positioned within the top receiving hole.

6. The golf putter with repositionable shaft according to claim 1, where the head enables exchange between more than one shaft.

7. The golf putter with repositionable shaft according to claim 1, where the shaft is selected from one of at least a standard shaft, a belly shaft and a long shaft.

8. The golf putter with repositionable shaft according to claim 1, where the head enables a right hand user and a left hand user to use the same head, by enabling repositioning of the shaft to either of the side top receiving holes.

9. The golf putter with repositionable shaft according to claim 1, where the bottom surface includes three bottom receiving holes aligned with the top receiving holes, where the bottom receiving holes accept three bolts where the bolts include a head and a threaded tail.

10. The golf putter with repositionable shaft according to claim 9, where the threaded tail of the bolt inserts into a bolt receiver within the insert to further secure the head to the shaft.

* * * * *